US005759091A

United States Patent [19]

MacMillan

[11] Patent Number: 5,759,091

[45] Date of Patent: Jun. 2, 1998

[54] ABRASIVE THROWING WHEEL ASSEMBLIES

[75] Inventor: William Robertson MacMillan, Bowdon, United Kingdom

[73] Assignee: Tilghman Wheelabrator Limited, Altrincham, United Kingdom

[21] Appl. No.: 708,859

[22] Filed: Sep. 4, 1996

Related U.S. Application Data

[62] Division of Ser. No. 350,519, Dec. 6, 1994, Pat. No. 5,577,953, which is a continuation of Ser. No. 989,029, Feb. 26, 1993, abandoned.

[30] Foreign Application Priority Data

Jul. 6, 1990 [GB] United Kingdom ..... 9014994

[51] Int. Cl.[6] ..... B24C 5/06

[52] U.S. Cl. ..... 451/95; 451/97; 415/115

[58] Field of Search ..... 451/94, 95, 96, 451/97, 98; 415/115; 416/223 R, 96 R, 97 R; 241/275

[56] References Cited

U.S. PATENT DOCUMENTS

| | | | |
|---|---|---|---|
| 3,160,992 | 12/1964 | Moore . | |
| 3,211,266 | 10/1965 | Abramovitz et al. . | |
| 3,513,597 | 5/1970 | De Groot et al. . | |
| 3,683,556 | 8/1972 | Leliaert | 51/9 |
| 4,069,025 | 1/1978 | Macmillan | 51/434 |
| 4,395,851 | 8/1983 | Watts | 51/434 |
| 4,697,391 | 10/1987 | Carpenter, Jr. et al. | 51/434 |

*Primary Examiner*—Eileen P. Morgan
*Attorney, Agent, or Firm*—Rudnick & Wolfe

[57] ABSTRACT

An abrasive throwing wheel assembly comprises a throwing wheel having parallel annular side plates (29) joined by spacers with the facing surfaces of the side plates having angularly-spaced registering throwing blade locating slots (30) and throwing blades (20) with lateral rails or edges (22) for location in the slots. The side wheels slots are wider than is customary and contain central radially-extending projections (30c). The lateral rails or edges of the throwing blades are grooved (28) from the tips inwardly for at least part of their lengths. The throwing blades are located by interengagement between the sidewall projects and the rail or edge grooves of the blades. This reduces the surface contact between the blades and the side plates with consequent reduction in the accumulation of jamming abrasive during use. Throwing blade removal is thus facilitated. The wider slots remove the narrow radial flow of high velocity abrasive or shot between the slot walls and throwing blade side rails or edges which is customary thus reducing side plate, especially side plate rim, wear.

5 Claims, 6 Drawing Sheets

ABRASIVE THROWING WHEEL ASSEMBLIES

This is a divisional of application(s) Ser. No. 08/350,519 filed on Dec. 6, 1994, now U.S. Pat. No. 5,577,953, which is a continuation of Ser. No. 07/989,029 filed on Feb. 26, 1993, now abandoned.

This invention relates to centrifugal abrasive throwing wheel assemblies such as are used in shot blasting machinery.

One form of throwing wheel assembly comprises, inter alia, a throwing wheel and a set of throwing blades. The throwing wheel comprises a pair of annular side plates conjoined in parallel relationship by spacers. The inside face of each side plates is formed with a number of angularly-spaced slots extending between the inner and outer diameters of the side plate, the numbers of slots' being equal to the number of throwing blades in the set of throwing blades. The slots in the side plates are in register and serve to mount the throwing blades within the throwing wheel.

A throwing blade has at least one throwing face and its lateral edges are usually of greater depth, viewing the throwing blade in transverse cross-section, but not necessarily so. The opposed lateral edges, so-called rails if of greater depth than the throwing face or faces, of a throwing blade engage and are located in a pair of registering slots to mount the throwing blade in the throwing wheel and various securing arrangements, well known to those skilled in the art, are employed releasably to retain the throwing blades within the throwing wheel for operational purposes.

Depending on the construction and/or dimensions of the throwing blades and the throwing wheel, and/or the throwing blade-securing arrangement employed, the throwing blades may be inserted into their locating slots or grooves either from the inner diameter or the outer diameter of the throwing wheel.

Thus with all known twin side plate throwing wheel assemblies the side plates are internally slotted to accept and locate complementarily-shaped solid lateral rails or edges of throwing blades, i.e. a female (side plate slots) and a male (solid throwing blade lateral rails or edges) connection and location.

The invention is especially but not exclusively concerned with a throwing wheel assembly in which the throwing blades are fitted into and withdrawn from the throwing wheel through the central opening of the throwing wheel, the blades being retained in position within the wheel by abutment of co-operating formations on the throwing blades and the side plates of the throwing wheel. Inward movement of the blades in the throwing wheel assembly is prevented by the presence of the customary removable control cage and vane-type impeller with combined or separate centering plate traversing the central openings of the side plates.

An example of such a throwing wheel assembly is disclosed in our United Kingdom Patent No. 1 500 092. In this patent, the side plates of the throwing wheel are, as is customary, radially slotted to receive and locate the lateral rails of the throwing blades, each slot at its inner end, i.e. adjacent to the central opening, being deeper than the remainder of the slot to define a ledge against which abuts a nose provided on each lateral rail of the throwing blade. Thus, in this Patent, there is disclosed lateral radial location of the throwing blades between the side plates. In this Patent, both faces of each throwing blade are identical so that the throwing wheel assembly is operationally reversible.

A variation of this throwing wheel assembly is disclosed in our European Patent No. 0148775 wherein each throwing blade has mounted in each lateral rail adjacent its inner end, when considering the throwing blade mounted in its throwing wheel, a synthetic polymeric or elastomeric strip which stands proud of the lateral rail and which lies within a dovetail-shaped groove disposed perpendicular to planes containing the throwing faces of the throwing blades. These strips serve both to provide a barrier to flow of fine abrasive and/or contaminations up the lateral rails of the throwing blades with consequent wear thereon and on the walls of the slots and to frictionally hold the throwing blades in position between the side plates of the throwing wheel until the centering plate, with or without the combined vane-type impellor and the control cage are located within the central opening of the throwing wheel.

The present invention is not restricted to the throwing blades and the throwing wheels disclosed in our aforesaid Patents.

With our aforesaid patented throwing wheel assemblies, worn throwing blades are removable for replacement purposes by firstly removing the control cage and the vane-type impeller with combined or separate centering plate and then tapping the throwing blades inwardly for removal through the central opening in one of the side plates.

However, in practice it is found that due to accumulation of abrasive between the side plates and the lateral rails of the throwing blades within the locating slots in the side plates, release of a throwing blade is resisted and it becomes necessary to hammer the throwing blades inwards to effect their release and subsequent removal. It sometimes happens that the throwing blades seize solid between the side plates necessitating scrapping of the whole throwing wheel assembly.

In addition, a consequence of such forcible release is the likelihood of damage to a motor shaft, or bearing house assembly, on which the throwing wheel assembly is mounted.

It is therefore an object of the present invention to provide a throwing blade and a throwing wheel for an abrasive throwing wheel assembly which obviates or mitigates such abrasive accumulation between throwing blades and side plates and consequently the need for such forcible removal from the abrasive throwing wheel assembly and the possible adverse consequences stemming therefrom.

It is also an object of this invention to provide throwing wheel side plates having throwing blade receiving slots of a configuration whereby side plate wear, and especially side plate rim wear, is substantially reduced.

According to a first and broadest aspect of the present invention there is provided a throwing blade for mounting in a throwing wheel of an abrasive throwing wheel assembly wherein a lateral rail or edge of the throwing blade is provided or formed with a female formation or configuration for blade location purposes.

The female formation or configuration serves to assist in engaging and locating the throwing blade within the locating slot in the side plate of a throwing wheel, and also provides an egress passage for abrasive along the throwing blade rail or edge.

According to a second aspect of the present invention there is provided a throwing blade for mounting in a throwing wheel of an abrasive throwing wheel assembly wherein a lateral rail or edge of the throwing blade is grooved to reduce the area of contact between the lateral rail or edge and the adjacent side plate of the throwing wheel.

As a result of such reduced area of contact hitherto jamming abrasive is either not retained between the throwing blade lateral rails or edges and the side plates of the throwing wheel, or, if it is, its removal is relatively easily effected before, and during, throwing blade removal.

Preferably, each lateral rail or edge of the throwing blade is grooved.

Preferably, each lateral rail or edge of the throwing blade is formed with a groove configuration extending inwardly from its tip.

The groove configuration may, depending on the throwing blade securing arrangement employed, extend the full length of the throwing blade lateral rail or edge, or may extend inwardly from the tip for part of the throwing blade length.

Preferably, in the latter case, the groove configuration stops at or adjacent a throwing blade securing formation.

Preferably, the securing formation is within each lateral rail or edge of a throwing blade.

Preferably, in the case of our aforesaid patented throwing blades, the groove configuration terminates at the locating nose of the lateral rail.

Preferably the groove configuration is of V-cross-section. It may, however, be of other cross-section, such, for example, as U or rectangular cross-section.

According to a third aspect of the present invention there is provided a side plate for a throwing wheel of an abrasive throwing wheel assembly, the side plate being of annular construction with a plurality of angularly-spaced radial slots extending between the inner and outer diameters of the side plate, each slot being divided or partitioned for at least part of its radial length by a throwing blade locating projection to define for said radial length part a pair of side-by-side sub-slots.

According to a fourth aspect of the present invention there is provided a throwing wheel for an abrasive throwing wheel assembly, the throwing wheel comprising a pair of side plates as defined in the immediately preceding paragraph connected in parallel relationship by angularly-spaced spacers.

It is to be clearly understood, however, that the throwing blades in accordance with the present invention can and may be employed with conventional and known throwing wheels, i.e. those where the side plates have single simple slots for receiving and locating throwing blade lateral rails or edges.

According to a fifth aspect of the present invention there is provided an abrasive throwing wheel assembly comprising a throwing wheel constituted by a pair of parallel side plates of annular construction joined by angularly-spaced spacers with the facing surfaces of the side plates being formed with a plurality of registering angularly-spaced radial slots extending between the inner and outer diameters of the side plates, and each slot being divided into two parallel sub-slots for at least part of its radial length by a blade locating projection, and a plurality of throwing blades mounted between the side plates with the lateral rails or edges of a respective throwing blade being located in a pair of respective registered slots, the lateral rails or edges of the throwing blade being grooved inwardly from the tip of the throwing blade to receive the locating projections in the slots.

The blade grooves and the side wall blade locating projections may be of such a configuration that there is angularly spaced facial and/or line (point) contact between the lateral rails or edges of the throwing blade and the blade locating projections of the side plates thereby easing throwing blade removal from between the side plates.

The aforesaid fifth aspect of the present invention may be modified in that the blade locating projections are omitted, i.e. the radial slots are simple single slots.

In this modification there are angularly spaced areas of facial contact between a side plate and the adjacent lateral rail or edge of a throwing blade.

A sixth aspect of the present invention is concerned with a throwing blade of the present invention as hereinbefore defined incorporating the synthetic polymeric or elastomeric location and barrier strips. In this aspect, each strip is moulded, preferably injection moulded, into its dovetail-shaped groove in the throwing blade lateal rail or edge and is in the form of a wiper blade which will give the required frictional holding and abrasive barrier characteristics.

The groove may be other than dovetail-shaped provided it can retain the flexible wiper blade in position on the throwing blade. It is likely that the flexible wiper blade will only stand proud laterally of the throwing blade lateral rail or edge.

In an alternative construction a synthetic polymeric or elastomeric insert may be located in the bottom of one, or each, groove of a throwing blade, preferably spaced from the blade securing formation for blade retention purposes.

Embodiments of the present invention will now be described, by way of example, with reference to the accompanying drawings, in which.

Figure 1:
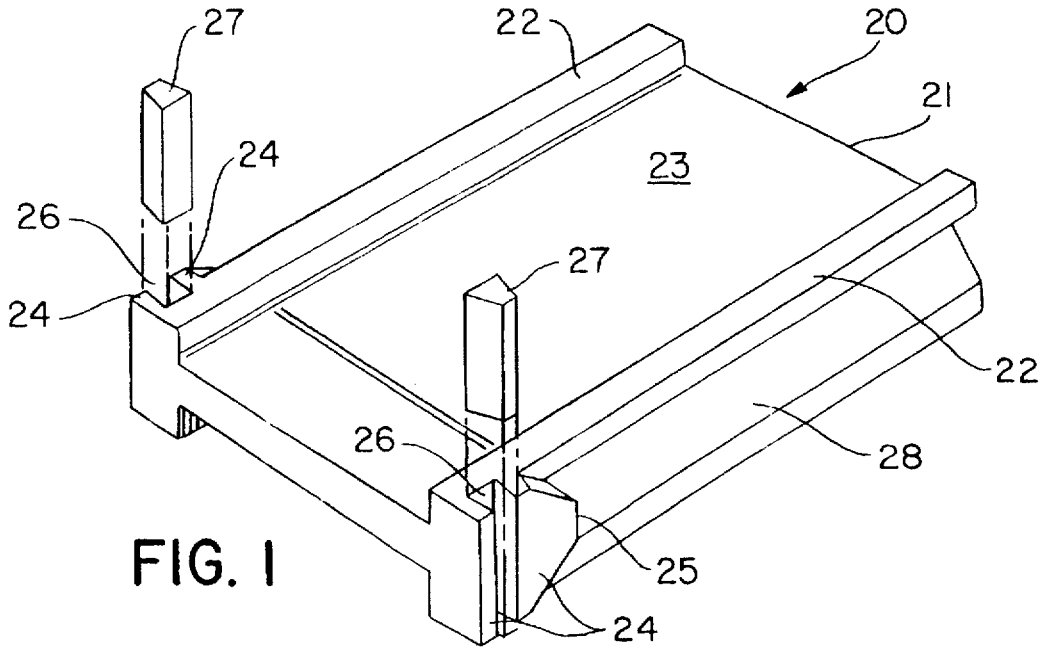
FIG. 1 is a perspective view of one form of throwing blade according to the present invention.
Figure 2:
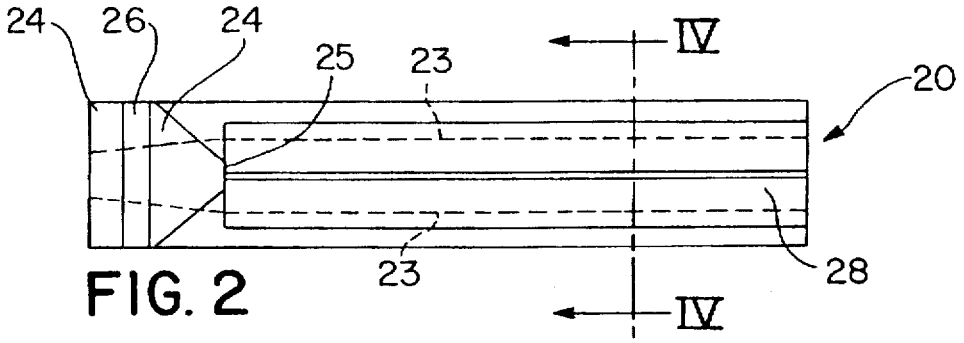
FIGS. 2 to 4 are respectively a side view, a plan view and a sectional view on line IV–IV of FIG. 2 of the throwing blade of FIG. 1.
Figure 3:
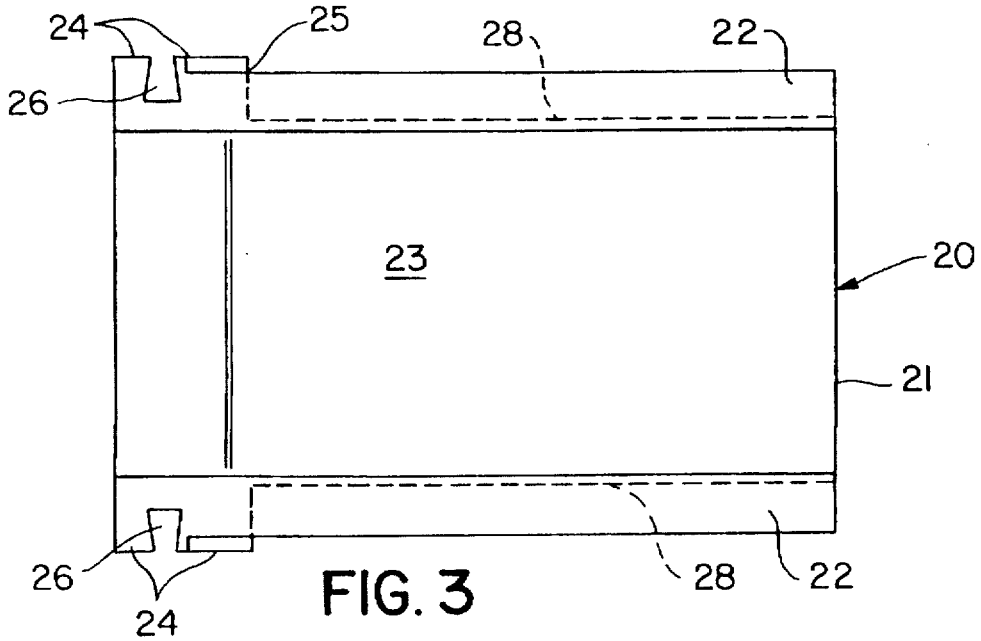
Figure 4:
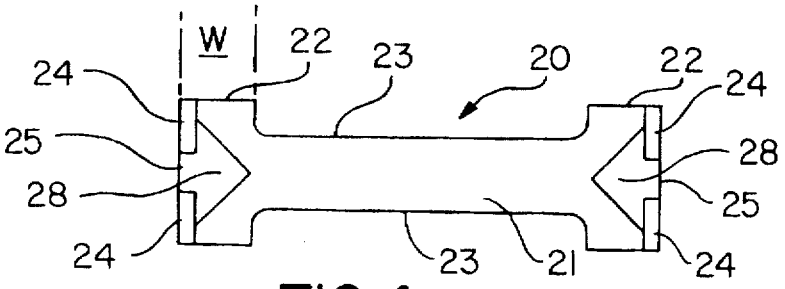
Figure 5:
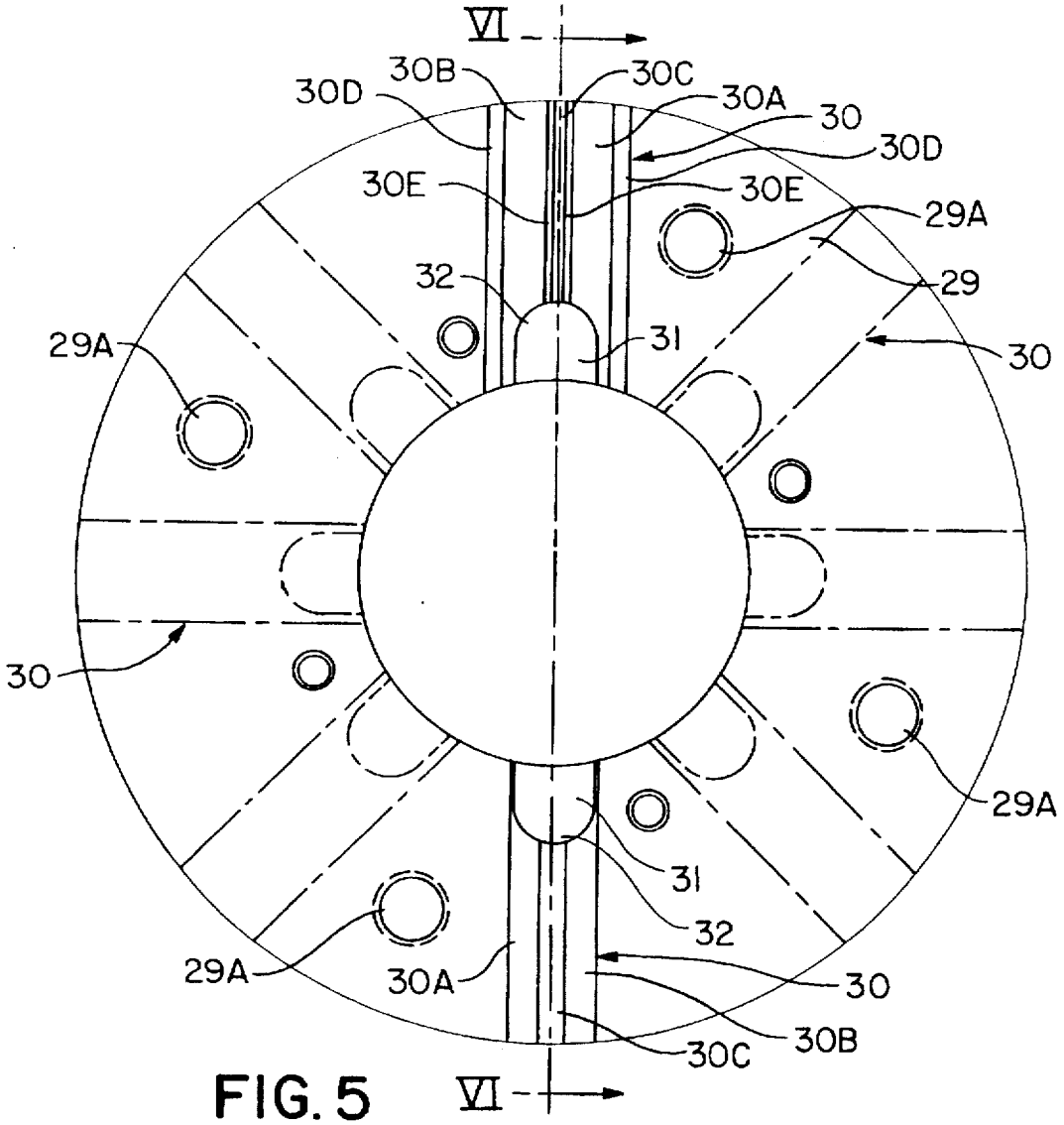
FIG. 5 is a plan view of the inside face of a side plate for a throwing wheel according to the present invention showing two alternative forms of dual slots or grooves.
Figure 6:
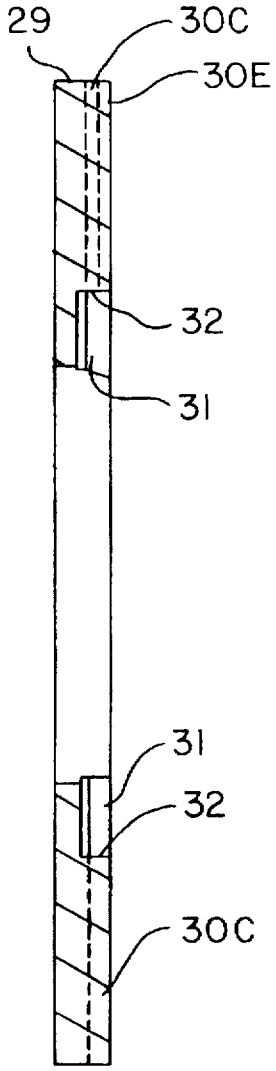
FIG. 6 is a section view on the line VI—VI of FIG. 5 through the slots or grooves.

The disclosures of our aforesaid United Kingdom Patent No. 1 500 092 and European Patent No. 0148775 are incorporated herein by reference and consequently the throwing blade and throwing wheel will not be described in any great detail other than those features pertinent to the present invention.

Briefly, the throwing blade 20 (see FIGS. 1 to 4 and FIG. 10) has an inner body 21 with integral lateral rails 22, the inner body 21 having two identical throwing faces 23 which renders the throwing blade 20 suitable for use in a reversible (bi-directional) abrasive throwing wheel assembly.

At the inner end of each lateral rail 22 is a laterally-projecting protuberance 24 tapered to define a blunt nose 25.

The laterally-projecting protuberance 24 has formed therein a dovetail-shaped slot 26 in which is force fitted a polymeric or elastomeric sealing strip 27 which stands proud of the protuberance 24 both laterally and at its ends.

The sealing strips 27 assists in reducing abrasive wear on the side plates of a throwing wheel in which the throwing blade 20 is mounted and in the location and retention of the throwing blade 20 between the side plates during throwing wheel assembly.

In connection with these sealing strip 27 reference is made to our European (UK) Patent No. 0148775.

In accordance with the present invention each lateral rail 22 is formed with a V-groove 28 open to the side face of the throwing blade 20 and extending from the tip of the latter to the blunt nose 25 of protuberance 24.

These grooves 28 define female configurations which are used to locate and retain the throwing blade 20 in position between side plates of a throwing wheel.

Due to this grooving of the lateral rails 22 the transverse width W of each lateral rail 22 is greater than usual. For example, 10 millimeters as opposed to the usual 7 millimeters.

It is to be understood that the slots 26 and strips 27 may be omitted if desired.

Referring now to the throwing wheel (see FIGS. 5 to 8 and FIG. 10) within which the aforesaid throwing blades 20 can be removably mounted, this comprises a pair of annular parallel side plates 29 joined together by spacers 29A, there being, between angularly-adjacent spacers 29A, throwing blade locating slots.

Each side plate 29 (see FIGS. 5 and 6 especially) is, as aforesaid, of annular construction and is formed with a series of angularly-spaced, radial, throwing blade locating slots generally indicated at 30.

More specifically in accordance with the present invention each of these slots 30 is divided into two sub-slots 30A, 30B for part of the radial length of the slot 30 by a centrally disposed projection 30C extending from the outer circumference of the side plate 29 to a recess 31 at the inner end of the slot 29, which recess 31 defines a ledge 32 against which the nose 25 of a throwing blade rail 22 will abut.

The sub-slots 30A and 30B are of rectangular cross-section (see FIG. 7) as is the separating projection 30C.

Figure 8:
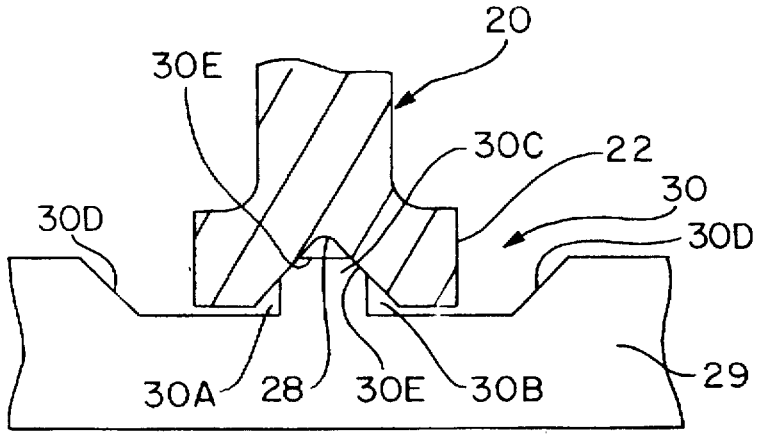
FIGS. 7 to 9 are fragmentary sectional views, to an enlarged scale, of respectively two alternative forms of throwing blades and side plates in accordance with the present invention, and a throwing blade in accordance with the present invention used with a conventional side plate.
Figure 7:
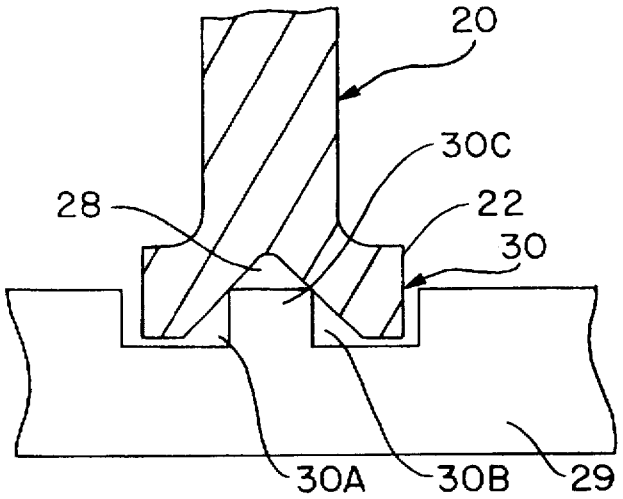

In FIG. 8 the sub-slots 30A and 30B are wider than those of the side plate of FIG. 7 and the lateral faces 30D of each slot 30 remote from the projection 30C is inclined away from the latter and inwardly relative to the outer face of the side plate 29.

Also, in this construction of side plate the corners of the projection 30C are chamfered to provide bearing surfaces 30E.

Figure 9:
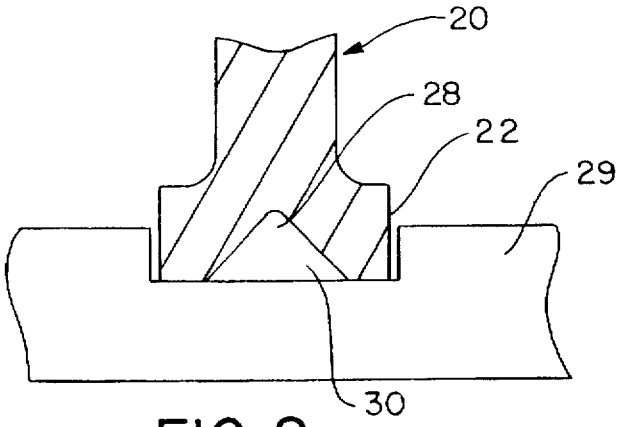

In FIG. 9, the slot or groove 30 in the side plate 29 is a conventional simple slot as is currently usual in the side plates of throwing wheels. The configuration of the lateral rail 22 of the throwing blade 20 is shown to conform with that of FIG. 7 but it may equally conform to that of FIG. 8.

This blade 20 (FIG. 9) may be secured between the side plates by the conventional back fixing method well known to those well skilled in the art and in this instance the grooves 28 will, or may, extend the full length of the blade 20.

It is to be understood that all the slots or grooves 30 in the side plates 29 of a particular throwing wheel will be or the same configuration, i.e. in accordance with FIG. 7 or FIG. 8 or FIG. 9 for example.

Referring again to FIGS. 5 to 7 and FIGS. 5, 6 and 8 it will be noted that in the latter case the overall width of the slots 30 are wider as a result of the inclined faces 30D and it is considered that these inclined faces 30D will assist in dispersal of abrasive from the slots 30 circumferentially as well as radially during throwing wheel assembly operation.

In both FIGS. 7 and 8 it will be noted that location of a throwing blade 20 between side plates 29 is effected by the engagement of the projections 30C (male formations) on the side plates 29 within the slots 30 (female formations) on the throwing blade 20.

In the FIG. 7 configuration it will be seen that there is only point or line contact between the throwing blade 20 and projections 30C of the side plates 29 of the throwing wheel, which point or line contact is spaced axially from circumferentially spaced areas of facial contact between the side face of the throwing blade 20 and the bottoms of the grooves 30.

While there is limited face-to-face contact between the throwing blade 20 and the projections 30C of the side plate 29 of the throwing wheel in the FIG. 8 configuration, it will be noted that there is both circumferential and axial spacing between the throwing blade 20 and its adjacent side plate 29.

In the FIG. 9 configuration, while the rail 22 of the throwing blade 20 makes face contact with the side plate 29 on all three sides there is a major interruption in this contact as a result of the grooves 28 in the blade rails 22.

Due to the axial or axial and circumferential spacing between the throwing blade lateral rails and the side plates, all of these configurations assist in removal of worn throwing blades 20 from between the side plates 29 of a throwing wheel.

A comparison of the throwing blades of FIGS. 7 and 8 shows that the side plate adjacent face of the lateral rail 22 of the latter presents a lesser area of rail contact to the side plate 29 than the former. This is due to the different contact configurations between the throwing blade rails 22 and the projections 30C of the grooves 30 of the side plates 29.

Reference is now made to FIGS. 11 to 14 which show a preferred throwing blade construction and throwing blade and side plate connection according to this invention.

The throwing blade 40 has a body 41 defining identical throwing faces 42 bounded by two lateral rails 43 of greater depth than the body 41.

Each lateral rail 43 is formed with a V-groove 44 extending from the tip 41A of the blade 40 for a major part of its length to a location 45 where the rail 43 is left full.

The groove 44, therefore, is arrested at 45 to define a securing formation.

A synthetic polymeric or elastomeric insert 46 is secured in any convenient manner within each groove 44 towards the bottom thereof, i.e. it does not fill the groove 44, and is spaced as indicated at 47 from the blade securing formation 45.

These inserts 46 serve primarily to assist in blade retention between the side plates of a throwing wheel during assembly and act secondarily as abrasive flow barriers during use of the throwing wheel.

The inserts 46 may be omitted or alternatively may be provided on one side only of the throwing blade 40.

Figure 11:
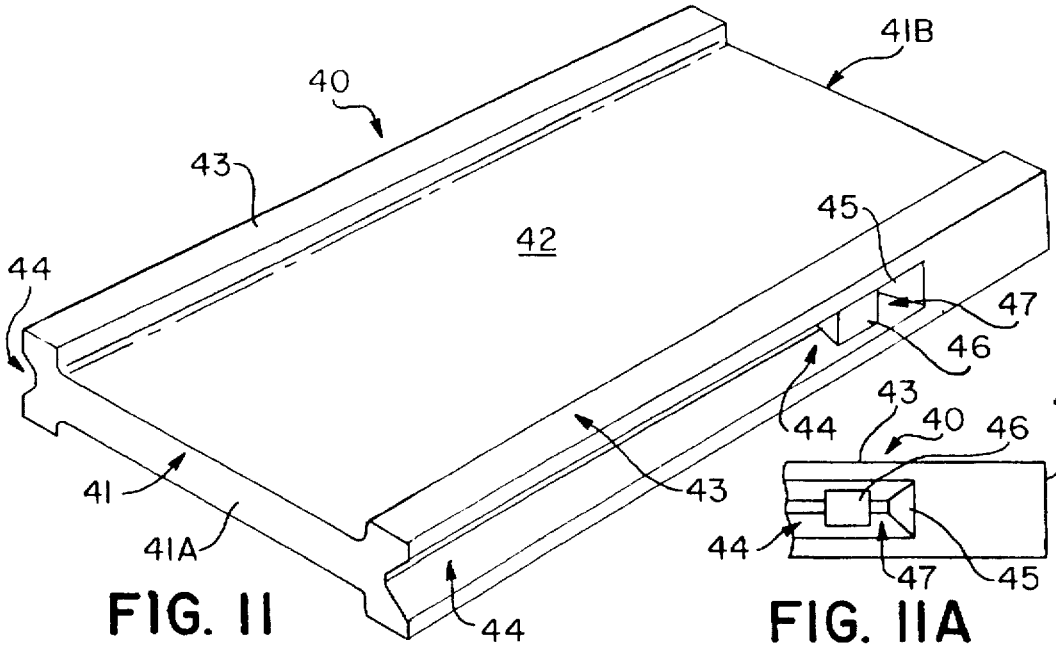
FIG. 11 is a perspective view of another and preferred form of throwing blade according this invention.
Figure 11A:
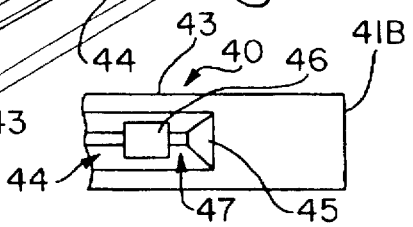
FIGS. 11A and 11B are respectively fragmentary side and end views of the blade of FIG. 11.
Figure 11B:
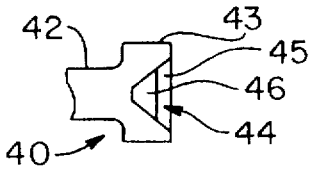

Throwing blades 40 in accordance with FIG. 11 may be produced by forming, in any convenient manner, a length of blade strip with the grooves 44 extending the full length of the strip, cutting the strip into the desired throwing blade lengths and thereafter, at one end, welding, tapping or otherwise securing within the grooves 44 inserts to provide the blade securing formation 45, or even simply depositing weld material in the grooves 44 at said ends to provide the necessary abutment surfaces. The abutment surfaces 45 can be provided in the grooves 44 in any convenient fashion.

It is to be understood that an abutment surface 45 can be provided in only one groove 44 of a throwing blade 40 if desired.

It is also to be understood that the abutment surface or surfaces can be omitted if the throwing blades are to be back fixed or side fixed in conventional manner as is well known to those skilled in the art.

Figure 12:
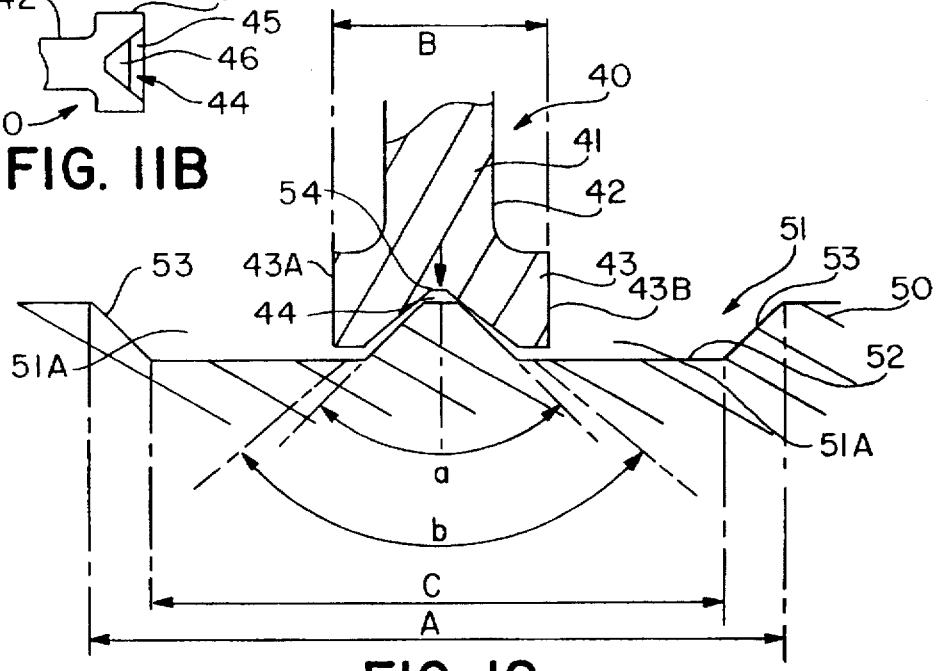
FIG. 12 is a detail fragmentary sectional view showing a preferred throwing blade and wheel side plate connection according to this invention.

Reference is now made particularly to FIG. 12 in which 50 indicates a throwing wheel side plate with a preferred form of slots 51 (only one shown).

The slot 51 viewed from the circumference of the side plate 50 has a flat base 52 bounded by two diverging inclined side walls 53.

A locating projection 54 is provided centrally of the slot 51 and is of triangular configuration with a narrow flat top in cross-section.

The following dimensions are given solely as examples and are in no way to be considered restrictive.

The angle a defined by the side walls of the projection 54 is equal to 90° while the angle b subtended by the side walls of the groove 44 is equal to 100°.

Consequently the blade rail 43 makes only line or point contact with the projection 54 at two angularly spaced locations, the remaining adjacent surfaces of the blade rail 43 and the projection 54 being in spatial relationship.

The angular width of the slot 51 at its widest part A is three times the thickness B of the throwing blade rail 43 and at its narrowest part C is two and one half times thickness B.

There is thus a substantial clearance between the lateral walls 53 of the slot 51 and the respective front or back face 43A, 43B of the lateral rail 43 of the throwing blade 40 and even greater spacing between each inclined face of the projection 54 and the adjacent inclined face 53 of the slot 51, the central projection 54 and the inclined side walls 53 defining, as has previously been mentioned parallel sub-slots 51A.

It can thus be seen from the above that the possibility of the abrasive catchment or trapping between the throwing blades and the side plates is substantially reduced when compared with existing throwing wheels of this general character, i.e. two side plates with replaceable throwing blades, so that blade removal is facilitated to a considerable extent.

Another important advantage of the throwing blade and side plate slot configuration of FIG. 12 is reduction in wear on the side plate 50, especially at its outer circumference or rim, thus increasing the working life of the throwing wheel.

It is well known to those skilled in the art that with known conventional throwing wheels the abrasive or short, during operation, accelerates up narrow radial gaps between the walls of the radial slots and the side rails or edges of the throwing blade located in these slots and, on reaching the rim of the side plates, the high velocity abrasive or short sweeps along the rims of the side plates and subjects same to considerable and sometimes very rapid wear. The side plates often become knife-edged at their rims and the throwing wheel requires to be replaced. The reason for this rim wearing action of the high velocity abrasive or shot is not fully understood but is a well established fact.

Viewing FIG. 12, it will be manifest that, due to the radial slot configuration (wide with inclined side walls) no abrasive or shot constraining narrow gaps are present between the inclined walls of the slot and the side rails or edges of the blade. This situation would equally apply if the walls 53 were vertical and spaced sufficiently away from the lateral rail 43 of a blade 40.

Consequently there is no build up of radially directed and confined abrasive or shot velocity, the abrasive or shot dispersing both angularly and radially in a free, non-confined manner due to centrifugal force during throwing wheel assembly rotation with resulting substantially less side plate wear and therefore increased working life of the throwing wheel.

Figure 13:
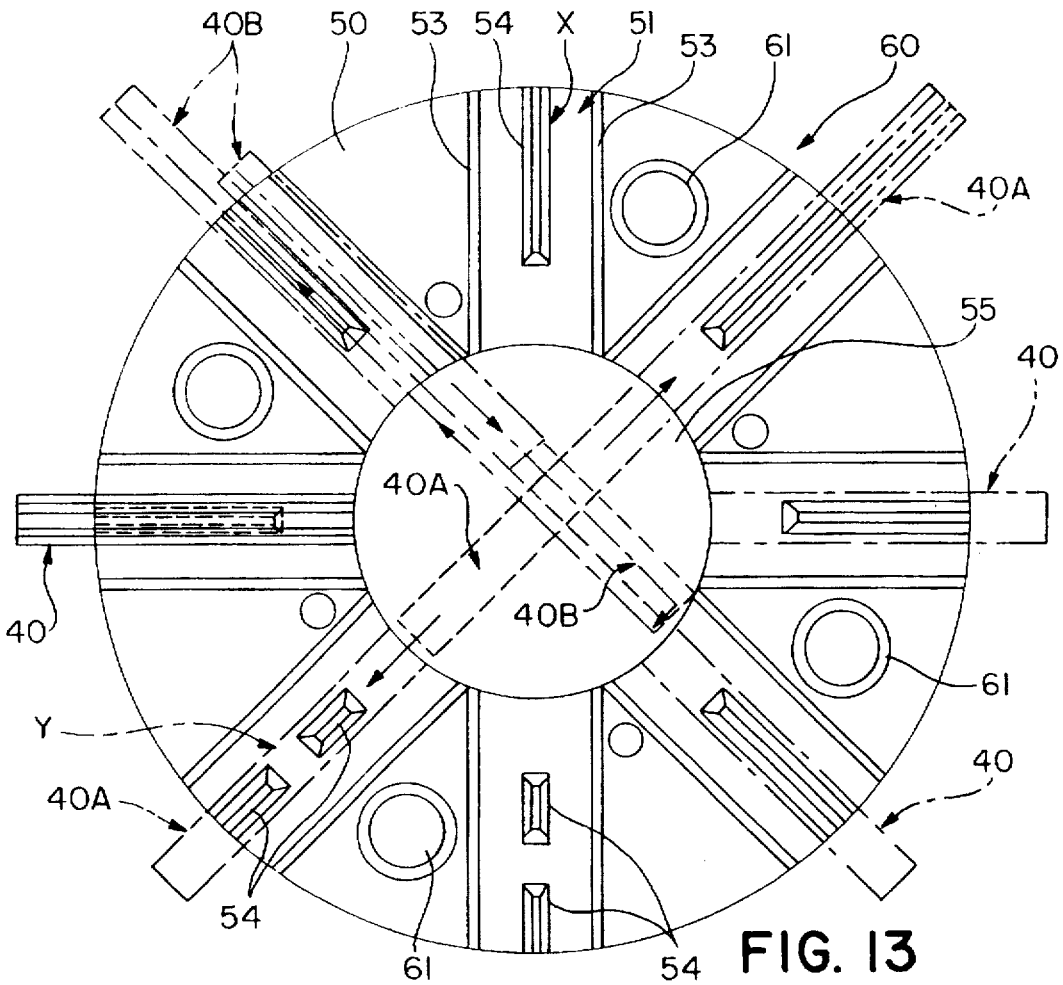
FIG. 13 is a side view of a throwing wheel side plate and throwing blades illustrating various features of the present invention.
Figure 14:
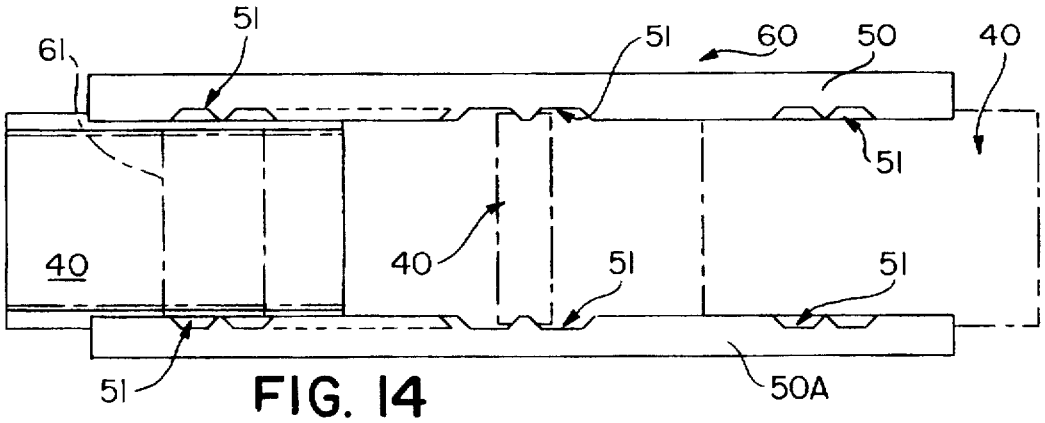
FIG. 14 is an end view of a throwing wheel according to this invention.

Reference is now made particularly to FIGS. 13 and 14 which show a throwing wheel 60 (see FIG. 14) constituted by two parallel side plates 50, 50A joined, in conventional manner, by spacers 61.

The side plates 50, 50A are formed with registering slots 51 as described with reference to FIG. 12 in which a fitted throwing blade 40 as described with reference to FIG. 11.

Firstly, it is to be noted that the central projection 54 may be of continuous length as exemplified at location X or it may be interrupted or discontinuous as indicated at location Y.

A throwing blade 40A of a length sufficient to pass through the central hole 55 of one of the side plates 50 can, as indicated by arrows, be slid into the slots 51 until the securing locations 45 abut the inner ends of the projections 54 which are received in the grooves 44.

If it is desired to employ throwing blades 40B of a length greater than the diameter of the central hole 55 this can be done by sliding the blade 40B down a sub-slat 51A then aligning the grooves 44 with the central projections 54 and then pulling the blade 40B back out until the securing formations 45 abut the ends of the central projections 54. The width of the sub-slots 51A permits such a manoeuvre.

As a result of the present invention and by suitably dimensioning the blade locating projections it is possible for a given size (external diameter) of throwing wheel to employ throwing blades of different lengths, the throwing blades, as aforesaid, being insertable between the side plates either through the centre of the side plates or from the outside rim of the side plates depending on throwing blade length, the sub-slots being used for such outside insertion.

The throwing blades of a given throwing wheel will usually be the same length.

Figure 15:
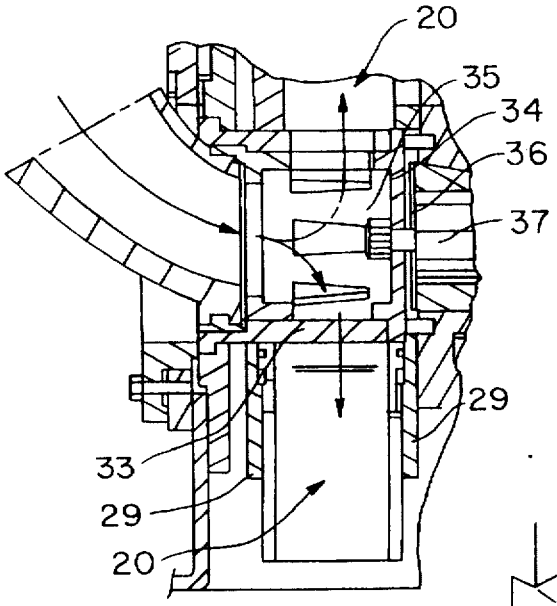
FIG. 15 is a fragmentary sectional elevation through an abrasive throwing wheel assembly incorporating the present invention.
Figure 10:
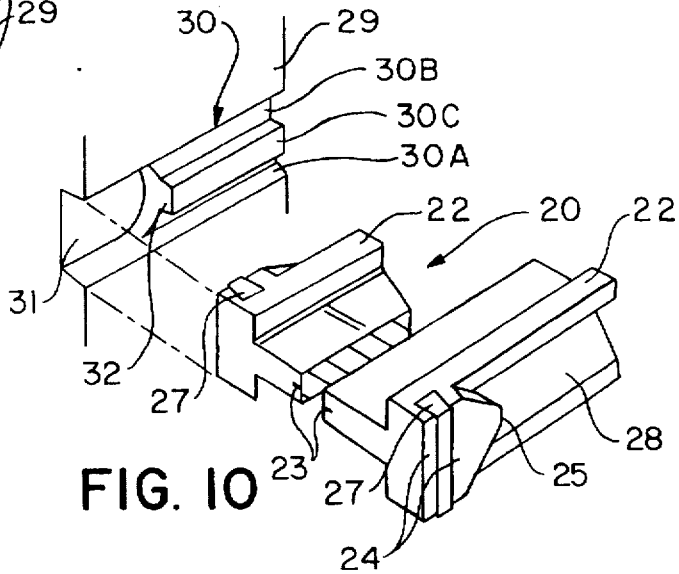
FIG. 10 is a fragmentary perspective view of the inner end of the throwing blade of FIG. 1 and an adjacent throwing wheel side plate in accordance with FIGS. 5 and 6.

Referring to FIG. 15 it can seen that the throwing blades 20 (40) as hereinbefore described in the throwing wheel assembly are retained in position between the side plates 29 (50) as hereinbefore described after central or external insertion by the control cage 33 and the integral centering plate 34 and vane-type impellor 35 which is removably secured to a wheel hub 36 bolted to one of the side plates 29 and secured to a motor shaft 37.

It is to be understood that the grooves 28 (44) in the lateral rails or edges 22 (43) of a throwing blade 20 (40) may extend the full length thereof and in this instance the slots 30 (51) in the side plates 29 (50) may also extend the full radial distance between inner and outer diameters of the side plate 29 (50).

With such a configuration of throwing blade and side plate, the throwing blade may, for example, be back-fixed through a spacer of the throwing wheel, or side-fixed through a side plate as is well-known to those skilled in the art.

Figure 16:
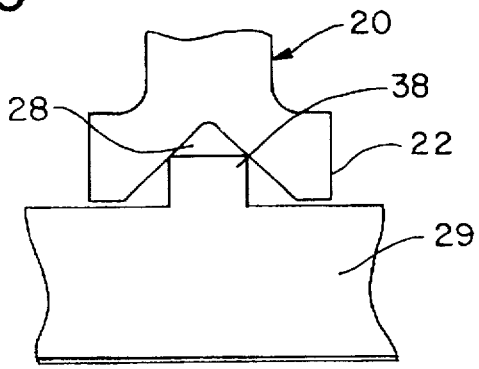
FIG. 16 is a fragmentary sectional view, to an enlarged scale, of yet another form of throwing blade and side plate.

FIG. 16 shows a possible further construction of throwing wheel in which the side plates 29 are not formed internally with throwing blade locating slots 30 but only with inwardly projecting ribs 38 eqivalent to projections 30C (54), the throwing blades 20 (40) being grooved in their lateral rails or edges 22 (43) as described, thus providing the reduced inter-facial contact, male/female connection between side plate/throwing blade which is the characteristic feature of the present invention.

The ribs 38 may be integral with or separate and attached to the side plates.

According to a seventh aspect of the present invention, therefore, there is provided an abrasive throwing wheel assembly comprising a throwing wheel having annular side plates with registering inwardly-directed projections provided thereon for mounting throwing blades formed with a lateral rail or edge of grooved or recessed configuration within which a projection can be located.

This aspect of the present invention also extends to a side plate for a throwing wheel having integral or separate but attached projecting ribs only (no slots or grooves) on its throwing blade mounting face.

I claim:

1. A throwing blade for use in an abrasive throwing wheel assembly, the blade comprising a rectangular body defining a tip, a radial inner end and a pair of parallel lateral edges, a longitudinal groove being formed in each lateral edge, each of which grooves is open at the tip and to a side of the body, and extends longitudinally from the tip to a location spaced from the radial inner end where it defines an abutment surface adapted for blade retention purposes within the throwing wheel assembly.

2. A throwing blade as claimed in claim 1 further comprising a blade securing formation positioned upon one of the lateral edges proximate to the radial inner end and projecting laterally beyond said one of the lateral edges.

3. A throwing blade as claimed in claim 2 further comprising a sealing strip extending laterally from the blade securing formation to provide a blade retention configuration and an abrasive flow barrier.

4. A throwing blade as claimed in claim 2 further comprising an insert disposed in the groove of said one of the lateral edges spaced from the blade securing formation to provide a blade retention configuration and an abrasive flow barrier.

5. A throwing blade as claimed in claim 1 wherein the body of the blade between its lateral edges defines opposed identical throwing faces.

* * * * *